United States Patent [19]

Holmér

[11] Patent Number: 4,829,949

[45] Date of Patent: May 16, 1989

[54] VALVE MECHANISM FOR AN INTERNAL COMBUSTION ENGINE

[75] Inventor: Ernst Holmér, Gothenburg, Sweden

[73] Assignee: AB Volvo, Gothenburg, Sweden

[21] Appl. No.: 153,717

[22] Filed: Feb. 8, 1988

[30] Foreign Application Priority Data

Feb. 26, 1987 [SE] Sweden ..... 8700820

[51] Int. Cl.[4] ..... F01L 1/34

[52] U.S. Cl. ..... 123/90.39; 123/90.16

[58] Field of Search ..... 123/90.16, 90.17, 90.2, 123/90.21, 90.39

[56] References Cited

U.S. PATENT DOCUMENTS

| | | | |
|---|---|---|---|
| 1,741,677 | 12/1929 | Brewer . | |
| 2,954,017 | 9/1960 | Forstner | 123/90.16 |
| 4,638,773 | 1/1987 | Bonvallet | 123/90.16 |

FOREIGN PATENT DOCUMENTS

| | | | |
|---|---|---|---|
| 3203791 | 8/1983 | Fed. Rep. of Germany . | |
| 2032705 | 11/1970 | France . | |
| 0155634 | 6/1982 | German Democratic Rep. | 123/90.15 |
| 0639042 | 6/1950 | Netherlands | 123/90.16 |
| 0028398 | 11/1917 | Norway | 123/90.16 |
| 0306212 | 2/1929 | United Kingdom . | |

*Primary Examiner*—Willis R. Wolfe
*Assistant Examiner*—M. Macy
*Attorney, Agent, or Firm*—Young & Thompson

[57] ABSTRACT

The invention relates to a valve mechanism for controlling a disc valve (1) of an internal combustion engine and comprises a control shaft (2) which is driven by the engine crankshaft, and a push rod (3) which is driven by the control shaft (2) and which for the purpose of transmitting reciprocating movement is connected to one arm (14) of a two-arm rocker (4) which is pivotable about a rocker shaft (15) and the other arm (16) of which rocker transmits these movements to the valve (1). The valve mechanism according to the invention is characterized in that the control shaft (2) is intended to act upon the push rod (3) in both directions of movement thereof; in that the first arm (14) of the rocker (4) extends essentially at right angles to the push rod (3) and the second arm (16) of the rocker extends essentially parallel with the longitudinal geometric axis of the valve (1); and in that a lifting arm (5) is provided for transferring rocker movement to the valve (1). The other arm (16) of the rocker (4) is provided with activating means (18) for coaction with the lifting arm (5), one end of which is pivotally mounted on a lifting arm shaft (19) and the other end of which is provided with means for activating the valve (1). The lifting arm surface (20) which co-acts with the second arm (16) of the rocker (4) is profiled in a manner to achieve the desired pattern of movement of the second end of the lifting arm (5) in response to movement of the rocker (4).

10 Claims, 3 Drawing Sheets

VALVE MECHANISM FOR AN INTERNAL COMBUSTION ENGINE

The present invention relates to a valve mechanism for controlling a poppet valve in an internal combustion engine and comprising a control shaft which is driven by the engine crankshaft, and a push rod which is driven by the control shaft and which for the purpose of transmitting reciprocatory movement is connected to one arm of a two-armed rocker which is pivotable about a rocker shaft and the other arm of which transmits said movements to the valve.

Valve mechanisms of this kind are widely used in various types of internal combustion engines. In these known mechanisms the control shaft has normally comprised a cam shaft for activation of the push rod, and the other arm of the rocker has normally acted upon the valve directly, possibly via an intermediate valve lifter. Such valve mechanisms have a simple construction and are reliable in operation. In valve mechanisms of this kind, the times at which the valve is opened and closed and also the height to which the valve is lifted is determined by the configuration of the cam on the cam shaft and by the transmission ratio of the rocker, with regard to valve lifting height. Consequently, in order to change the valve opening and closing times or the valve lifting height, it is necessary to reconstruct the valve mechanism and/or to change the cam shaft.

In recent years different systems have been developed for improving the working sequence in the cylinders of internal combustion engines so that combustion is more complete and engine efficiency is increased, these developments being undertaken for reasons of economy and in order to decrease the emission of harmful constituents in the exhaust gases from internal combustion engines. A number of such systems are described in Swedish Patent Application Nos. 8503517-8; 8700115-2 and 8700116-0. The advantages afforded by these systems, however, can not be utilized to the full with valve mechanisms of the aforedescribed kind, and it is therefore necessary to compromise and avail upon these advantages within a relatively limited part of the working range of the engine.

Accordingly, the object of this invention is to provide a valve mechanism which will make it possible to utilize the advantages obtainable with, e.g., the aforementioned systems designed for controlling the working cycle of internal combustion engines. This object is achieved with an inventive valve mechanism having the characteristic features set forth in the characterizing clause of claim 1.

Advantageous embodiments which enhance the possibilities of utilizing the advantages afforded, e.g., by the aforementioned systems are defined in the dependent claims.

Figure 1:
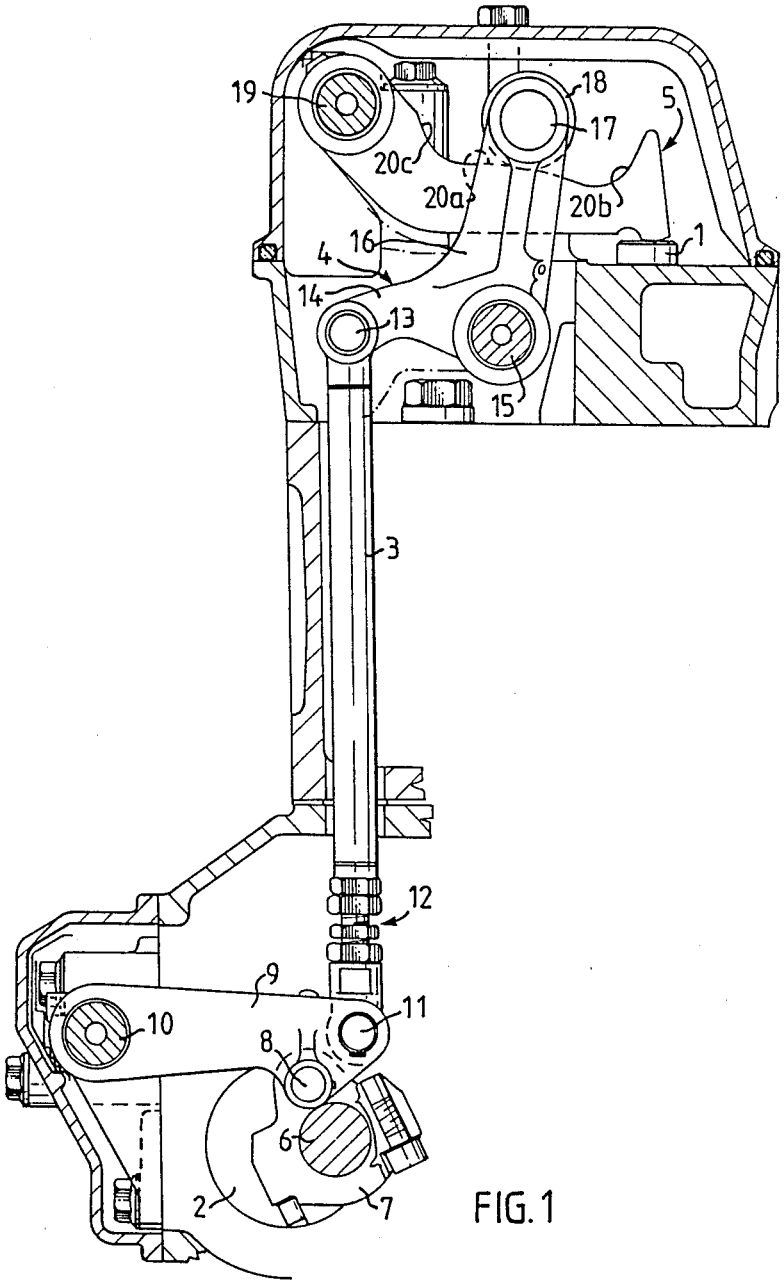
Figure 2:
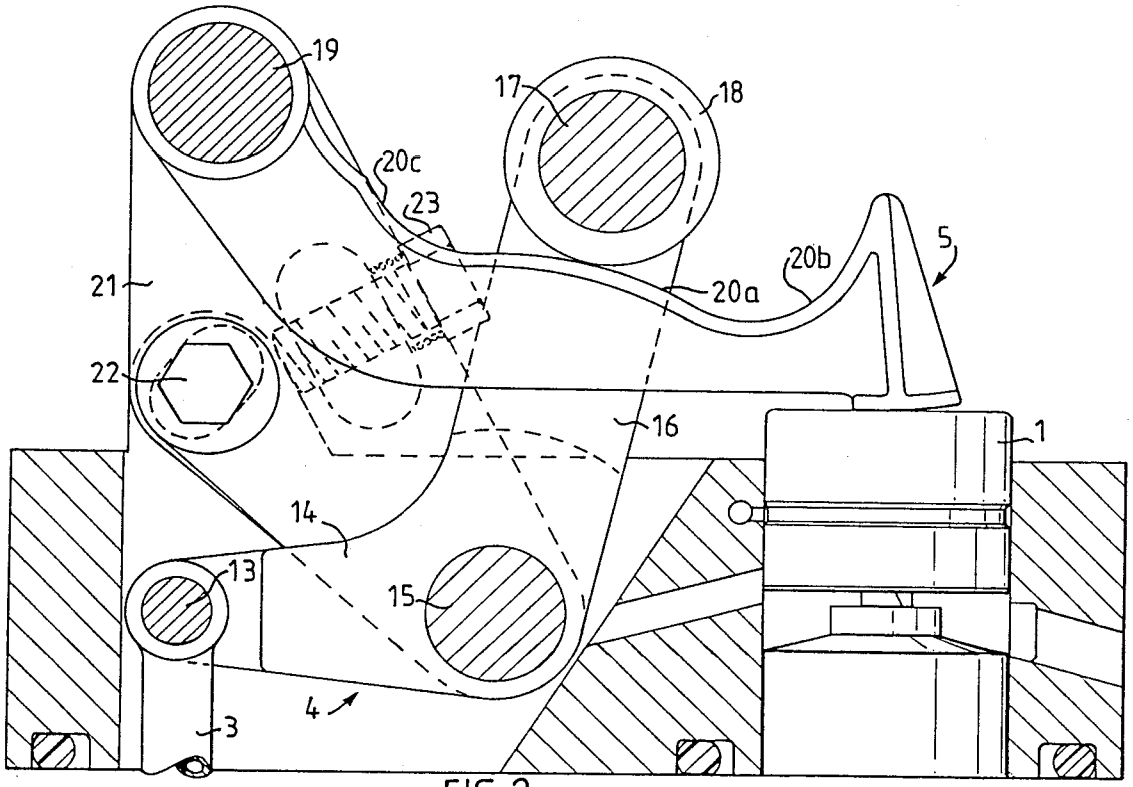
Figure 3:
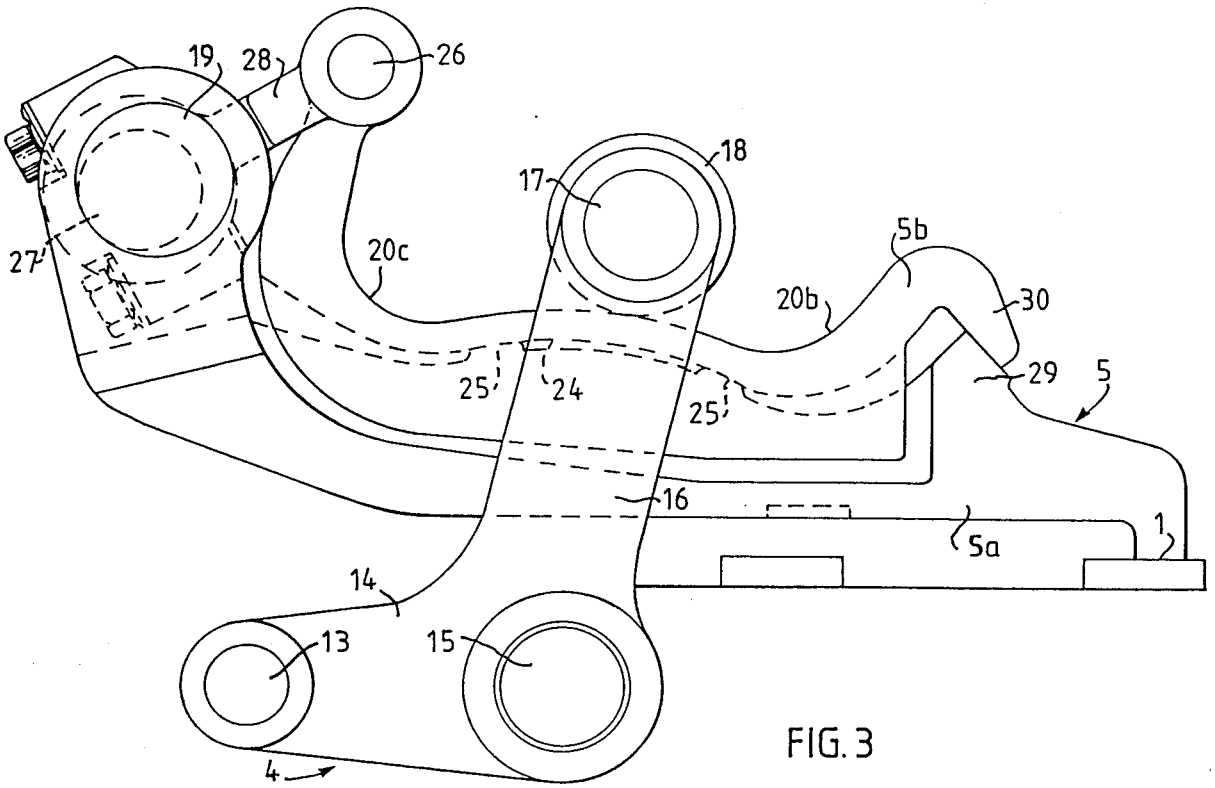

The invention will now be described in more detail with reference to the accompanying drawings, in which FIG. 1 is a vertical sectional view of part of an internal combustion engine fitted with a valve mechanism according to a first embodiment of th invention;

FIG. 2 is a vertical sectional view of part of a valve mechanism according to a second embodiment of the invention; and FIG. 3 illustrates part of a valve mechanism according to a third embodiment of the invention.

The valve mechanism illustrated in FIG. 1 is fitted to an internal combustion engine, the major parts of which are of conventional construction and are not therefore shown in detail here. The valve mechanism is intended to control the movements of a valve 1, of which only a small part of the valve stem is shown. The valve mechanism includes a control shaft 2 which is intended to be driven by the engine crank shaft in the same manner as the cam shaft in a valve mechanism of the kind described in the first paragraph of this specification. The control shaft 2 drives a push rod 3, in a manner hereinafter described, the lower end of which is coupled to the control shaft 2 and the upper end of which is coupled to a rocker 4. The rocker 4 is, in turn, intended to act upon a lifting arm 5, which in turn activates the valve 1.

As shown in FIG. 1, the control shaft 2 is provided with a crank pin 6 which is connected to a pin 8 on a control arm 9 through the intermediary of a short connecting rod 7. One end of the control arm 9 is pivotally mounted on a pin 10 which is fixedly mounted in the engine, whereas the other end of the control arm is pivotally connected to the lower end of the push rod 3 by means of a pin 11. Also located at the lower end of the push rod 3, in the proximity of the pin 11, is a length adjustment means 12 by means of which the length of the push rod 3 can be adjusted so as to achieve correct functioning of the valve mechanism.

The upper end of the push rod 3 is pivotally connected to a first arm 14 on the rocker 4 by means of a pin 13. The rocker 4 is a double-arm rocker and is journalled on a rocker shaft 15, which is stationarily fitted to the engine. The free end of the other rocker arm 16 carries a roller 18 which is journalled for rotation on a pin 17. One end of the lifting arm 5 is journalled on a lifting-arm shaft 19, which is fitted stationarily to the engine. As beforementioned, the free end of the lifting arm 5 is intended to act upon the valve 1 when the lifting arm 5 is swung about its shaft 19.

The upper side of the lifting arm 5 presents a profiled surface 20 which consists of three parts **20*a*, 20*b*, 20*c* of mutually different curvature, as described in more detail hereinafter. The profiled surface 20 is intended to coact with the roller 18 on the rocker 4 so as to produce desired movements of the valve 1. The part 20*a* of the profiled surface is convex and partly cylindrical, and has a radius of curvature such that its centre of curvature coincides essentially with the geometric axis of the rocker shaft 15. This means that when the roller 18 moves over the surface part 20*a*, in response to rocker movement, the lifting arm 5 is held essentially stationary. The surface part 20*b* adjoins the surface part 20*a* at the end thereof distal from the lifting arm shaft 19 and has a concave curvature. This means that when the roller 18 moves in over the surface part 20*b*, the lifting arm will be pressed downwards and will in turn press down the valve 1, causing the valve to open. In this regard the speed at which the valve is opened, and to which extent, is determined by the diameter of the roller 18 and the curvature of the surface part 20*b*. The surface part 20*b* is thus curved in the same direction as the peripheral surface of the roller 18, although the radius of curvature of the surface part 20*b* is larger than the diameter of the roller 18. Because the roller 18 and the surface part 20*b*** are curved in the same direction but have mutually different radii of curvature, it is possible to obtain greater acceleration in valve opening movements than can be obtained with prior art valve mechanisms, without overloading the components.

The end of the surface part **20*a* located nearest the lifting arm shaft 19 adjoins a surface part 20*c* which has a concave curvature and which through co-action with the roller 8 on the rocker 4** enables the valve to be opened a second time during each working cycle of the engine. This enables the method described in Swedish Patent Application No. 8503517-8 to be carried out in a particularly simple manner, according to which method the engine exhaust valve is opened a second time during each working cycle of the engine.

FIG. 2 illustrates a second embodiment of the inventive valve mechanism. Those components of the FIG. 2 embodiment which find direct correspondence with the FIG. 1 embodiment are identified with the sam reference numerals, and the lower part of the push rod 3 and the pushrod drive mechanism have been omitted in the FIG. 2 illustration.

The valve mechanism illustrated in FIG. 2 operates essentially in the same manner as the valve mechanism illustrated in FIG. 1. The valve mechanism according to FIG. 2, however, affords a further possibility of adjusting the mutual relationship between the roller 18 on the free end of the other rocker arm 16 and the surface part 20*a*, 20*b* and 20*c* of the profiled surface on the lifting arm 5. This further possibility has been provided by mounting the lifting arm shaft 19 of the FIG. 2 embodiment on a plate 21 which can be swung around the geometric axis of the rocker shaft 15 and which can be locked firmly in desired positions by means of a lock screw 22. A setting screw 23 co-acts with the plate 21, to enable the plate to be adjusted to the position desired. By pivoting the plate 21, which results in axial displacement of the lifting arm shaft 19, the lifting arm 5 is displaced, so as to alter the engagement between the roller 18 on the rocker 4 and the surface parts 20*a*, 20*b* and 20*c* on the lifting arm 5.

FIG. 3 illustrates a further embodiment of the inventive valve mechanism, wherewith those components which find direct correspondence in the aforedescribed embodiments have been identified with the same reference numerals. Further engine components have been omitted in the FIG. 3 embodiment.

The main difference between the embodiment illustrated in FIG. 3 and the aforedescribed embodiments is that the lifting arm 5 of the FIG. 3 embodiment consists of two parts, namely a first part 5*a* which is journalled on the lifting arm shaft 19 and intended to act on the valve 1, and a second part 5*b* which is displaceably journalled on the first part 5*a* and incorporates the profiled surface 20 having the surface parts 20*a*, 20*b* and 20*c*. In this case, the second part 5*b* of the lifting arm 5 is provided with a surface 24 which faces the first part 5*a* and which is part-cylindrical and has a radius such that its centre of curvature coincides essentially with the geometric axis of the rocker shaft 15. As shown in FIG. 3, the surface 24 abuts shoulders 25 on the first part 5*a* of the lifting arm 5.

In order to enable the second part 5*b* to be displaced axially in relation to the first part 5*a*, the end of the second part 5*b* facing the lifting arm shaft 19 is provided with a pin 26. The lifting arm shaft 19 is also provided with a crankpin 27 and a connecting rod 28 is connected between the crank pin 27 and the pin 26. Rotation of the lifting arm shaft 19 causes the connecting rod 28 to displace the pin 26 axially, under the influence of the crankpin 27, therewith displacing the whole of the second part 5*b* of the lifting arm 5, this displacement of the lifting arm part 5*b* being effected through abutment between the surface 24 on the second part 5*b* and the shoulders 25 on the first part 5*a*. This mutual movement between the lifting arm parts 5*a* and 5*b* is further guided through the mutual abutment of projections 29 and 30 on respective parts 5*a* and 5*b*, wherewith the mutually abutting surfaces of the projections 29 and 30 have a curvature such that their respective centres of curvature lie essentially on the geometric axis of the rocker shaft 15.

By rotating the lifting arm shaft 19 with the aid of suitable auxiliary devices (not shown), it is possible to displace the second part 5*b* of the lifting arm 5 while the engine is running, which enables the valve opening and/or valve closing times and/or the valve lifting height to be changed with the engine running. This enables those advantages afforded by the methods described in Swedish Patent Application Nos. 8700115-2 and 8700116-0 to be utilized to the full.

It is possible with all of the aforedescribed embodiments to select the times at which the valve 1 shall open or close, and also the height to which the valve is lifted, and also to choose whether the valve shall open once or twice during an engine cycle, by suitable dimensioning of the valve mechanism components. The inventive valve mechanism also enables the valve to be opened very rapidly, without the surface pressures between mutually coacting component parts becoming too high. Because movements of the rocker are guided positively in both directions of movement, the mass of those component parts which are accelerated with the aid of valve springs when closing the valve is also reduced in comparison with the case in prior art valve mechanisms of this kind. In the case of the inventive valve mechanism, these component parts namely comprise solely the valve 1 and the lifting arm 5.

It will be understood that the invention is not restricted to the aforedescribed embodiments and that modifications can be made within the scope of the following claims.

I claim:

1. A valve mechanism intended for controlling a poppet valve (1) in an internal combustion engine and comprising a control shaft (2) which is driven by the engine crank shaft, and a push rod (3) which is driven by the control shaft and which for the purpose of transmitting reciprocal movement is connected to one arm (14) of a two-arm rocker (4) which is pivotable about a rocker shaft (15) and the other arm (16) of which transmits said movements to the valve (1), characterized in that the control shaft (2) is intended to act on the push rod (3) in both directions of movement thereof; in that the first arm (14) of the rocker (4) extends substantially at right angles to the push rod (3) and the second arm (16) of said rocker extends substantially parallel with the geometric longitudinal axis of the valve (1); in that a lifting arm (5) is provided for transmission of rocker movement to the valve (1), in that the second arm (16) of the rocker (4) is provided with activating means (18) for co-action with the lifting arm (5), the one end of which is pivotally mounted on a lifting arm shaft (19) and the other end of which is provided with a member for activating the valve (1); and in that the surface (20) of the lifting arm (5) co-acting with the second arm (16) of the rocker (4) is profiled in a manner to achieve the desired pattern of movement of the other end of the lifting arm (5) during pivotal movement of the rocker (4).

2. A valve mechanism according to claim 1, characterized in that the control shaft comprises a crank shaft or eccentric shaft (2) having a crankpin (6) or an eccentric pin; and in that the connection between the crank pin or eccentric pin (6) of the control shaft (2) and the push rod (3) includes a connecting-rod like means (7) for converting rotary movement of the crankpin or eccentric pin (6) to a substantially reciprocating movement of the push rod (3).

3. A valve mechanism according to claim 2, characterized in that one end of the connecting-rod like means (7) is rotatably journalled on the crankpin or eccentric pin (6), and in that the other end of said means is rotatably journalled on a pin (8) located on a guide arm (9), one end of which is pivotally journalled on a fixed pin (10) and the other end of which is pivotally connected to the end of the push rod (3).

4. A valve mechanism according to claim 1, characterized in that the second arm (16) of the rocker (4) carries a rotatably journalled roller (18) intended for co-action with the profiled surface (20) on the lifting arm (5), said surface (20) being configured with a first part-cylindrical part (20*a*), the centre of curvature of which coincides essentially with the geometric axis of the rocker shaft (15), so that when the roller (18) moves over said first surface part the lifting arm (5) is held substantially stationary, and with a second surface part (20*b*) which adjoins the first surface part (20*a*) at one end thereof and which has a different curvature to said first surface part (20*a*), such that when the roller (18) moves across said second surface part the lifting arm (5) will be swung to activate the valve (1).

5. A valve mechanism according to claim 4, characterized in that the second part surface (20*b*) of the lifting arm surface (20) co-acting with the roller (18) is curved in the same direction as the peripheral surface of the roller (18) but has a larger radius of curvature than said roller.

6. A valve mechanism according to claim 4, characterized in that the profiled surface (20) on the lifting arm (5) is configured with a third part surface (20*c*) which adjoins the other end of the first part surface (20*a*) and has a different curvature to said first part surface, such that when the roller (18) moves across said third part surface the lifting arm (5) will be swung to activate the valve (1).

7. A valve mechanism according to claim 1, characterized in that the profiled surface (20) of the lifting arm (5) can be displaced in the direction of its longitudinal axis around a curved part whose centre of curvature coincides essentially with the geometric axis of the rocker shaft (15).

8. A valve mechanism according to claim 7, characterized in that the whole of the lifting arm (5) can be displaced axially by displacing the lifting arm shaft (19) along a curved path whose centre of curvature coincides essentially with the geometric axis of the rocker shaft (15).

9. A valve mechanism according to claim 7, characterized in that the lifting arm (5) comprises two parts (5*a*, 5*b*), of which the first part (5*a*) is journalled on the lifting arm shaft (19) and carries means for activating the valve (1), whereas the second part (5*b*) is displaceably journalled on the first part (5*a*) and incorporates the profiled surface (20).

10. A valve mechanism according to claim 9, characterized by a crank mechanism (26–28) which is intended to guide the displacement movements of the second part (5*b*) and which includes a crankpin (27) on the lifting arm shaft (19) and a connecting rod (27) which is connected between the crankpin (27) and the second lifting arm part (5*b*) for converting rotational movement of the lifting arm shaft (19) to linear movement of the second lifting arm part (5*b*).

* * * * *